US008428959B2

(12) United States Patent
Chu et al.

(10) Patent No.: US 8,428,959 B2
(45) Date of Patent: Apr. 23, 2013

(54) AUDIO PACKET LOSS CONCEALMENT BY TRANSFORM INTERPOLATION

(75) Inventors: Peter Chu, Lexington, MA (US); Zhemin Tu, Austin, TX (US)

(73) Assignee: Polycom, Inc., San Jose, CA (US)

( * ) Notice: Subject to any disclaimer, the term of this patent is extended or adjusted under 35 U.S.C. 154(b) by 461 days.

(21) Appl. No.: 12/696,788

(22) Filed: Jan. 29, 2010

(65) Prior Publication Data

US 2011/0191111 A1 Aug. 4, 2011

(51) Int. Cl.
*G10L 21/00* (2006.01)
*G10L 19/00* (2006.01)

(52) U.S. Cl.
USPC ..... 704/500; 704/219; 700/94

(58) Field of Classification Search ..... 704/219, 704/500; 700/94
See application file for complete search history.

(56) References Cited

U.S. PATENT DOCUMENTS

| | | | | | |
|---|---|---|---|---|---|
| 4,754,492 | A | | 6/1988 | Malvar | |
| 5,148,487 | A | | 9/1992 | Nagai et al. | |
| 5,317,672 | A | | 5/1994 | Crossman et al. | |
| 5,572,622 | A | * | 11/1996 | Wigren et al. | 704/228 |
| 5,664,057 | A | | 9/1997 | Crossman et al. | |
| 5,673,363 | A | * | 9/1997 | Jeon et al. | 704/270 |
| 5,805,469 | A | * | 9/1998 | Okamoto et al. | 702/189 |
| 5,805,739 | A | | 9/1998 | Malvar et al. | |
| 5,819,212 | A | * | 10/1998 | Matsumoto et al. | 704/219 |
| 5,859,788 | A | | 1/1999 | Hou | |
| 5,924,064 | A | | 7/1999 | Helf | |
| 6,029,126 | A | * | 2/2000 | Malvar | 704/204 |
| 6,058,362 | A | | 5/2000 | Malvar | |
| 6,496,795 | B1 | | 12/2002 | Malvar | |
| 6,597,961 | B1 | * | 7/2003 | Cooke | 700/94 |
| 6,973,184 | B1 | * | 12/2005 | Shaffer et al. | 379/420.01 |
| 7,006,616 | B1 | * | 2/2006 | Christofferson et al. | 379/202.01 |
| 7,024,097 | B2 | * | 4/2006 | Sullivan | 386/241 |
| 7,142,775 | B2 | * | 11/2006 | Sullivan | 386/207 |

(Continued)

FOREIGN PATENT DOCUMENTS

| | | |
|---|---|---|
| EP | 0718982 | 6/1996 |
| EP | 1688916 | 8/2006 |

(Continued)

OTHER PUBLICATIONS

Extended European Search Report in corresponding EP Appl. No. 11000718.4-2225, dated May 25, 2011.

(Continued)

*Primary Examiner* — Talivaldis Ivars Smits
*Assistant Examiner* — Shaun Roberts
(74) *Attorney, Agent, or Firm* — Wong, Cabello, Lutsch, Rutherford & Brucculeri, L.L.P.

(57) ABSTRACT

In audio processing for an audio or video conference, a terminal receives audio packets having transform coefficients for reconstructing an audio signal that has undergone transform coding. When receiving the packets, the terminal determines whether there are any missing packets and interpolates transform coefficients from the preceding and following good frames. To interpolate the missing coefficients, the terminal weights first coefficients from the preceding good frame with a first weighting, weights second coefficients from the following good frame with a second weighting, and sums these weighted coefficients together for insertion into the missing packets. The weightings can be based on the audio frequency and/or the number of missing packets involved. From this interpolation, the terminal produces an output audio signal by inverse transforming the coefficients.

51 Claims, 6 Drawing Sheets

U.S. PATENT DOCUMENTS

| | | | | |
|---|---|---|---|---|
| 7,167,633 | B2 * | 1/2007 | Sullivan | 386/207 |
| 7,171,107 | B2 * | 1/2007 | Sullivan | 386/207 |
| 7,181,124 | B2 * | 2/2007 | Sullivan | 386/284 |
| 7,187,845 | B2 * | 3/2007 | Sullivan | 386/207 |
| 7,194,084 | B2 * | 3/2007 | Shaffer et al. | 379/420.01 |
| 7,242,437 | B2 * | 7/2007 | Sullivan | 348/500 |
| 7,248,779 | B2 * | 7/2007 | Sullivan | 386/207 |
| 7,596,488 | B2 | 9/2009 | Florencio et al. | |
| 7,612,793 | B2 * | 11/2009 | Potekhin et al. | 348/14.01 |
| 7,627,467 | B2 | 12/2009 | Florencio et al. | |
| 2002/0007273 | A1 * | 1/2002 | Chen | 704/229 |
| 2002/0089602 | A1 * | 7/2002 | Sullivan | 348/500 |
| 2002/0116361 | A1 * | 8/2002 | Sullivan | 707/1 |
| 2004/0049381 | A1 * | 3/2004 | Kawahara | 704/219 |
| 2005/0024487 | A1 * | 2/2005 | Chen | 348/14.13 |
| 2005/0058145 | A1 | 3/2005 | Florencio et al. | |
| 2005/0111826 | A1 * | 5/2005 | Sullivan | 386/65 |
| 2005/0111827 | A1 * | 5/2005 | Sullivan | 386/65 |
| 2005/0111828 | A1 * | 5/2005 | Sullivan | 386/65 |
| 2005/0111839 | A1 * | 5/2005 | Sullivan | 386/125 |
| 2005/0117879 | A1 * | 6/2005 | Sullivan | 386/65 |
| 2005/0151880 | A1 * | 7/2005 | Sullivan | 348/500 |
| 2006/0023871 | A1 * | 2/2006 | Shaffer et al. | 379/420.01 |
| 2006/0067500 | A1 * | 3/2006 | Christofferson et al. | 379/202.01 |
| 2006/0078291 | A1 * | 4/2006 | Sullivan | 386/65 |
| 2006/0158509 | A1 * | 7/2006 | Kenoyer et al. | 348/14.08 |
| 2006/0209955 | A1 | 9/2006 | Florencio et al. | |
| 2007/0009049 | A1 * | 1/2007 | Sullivan | 375/240.28 |
| 2007/0064094 | A1 * | 3/2007 | Potekhin et al. | 348/14.08 |
| 2007/0291667 | A1 * | 12/2007 | Huber et al. | 370/260 |
| 2008/0097749 | A1 | 4/2008 | Xie et al. | |
| 2008/0097755 | A1 | 4/2008 | Xie | |
| 2008/0234845 | A1 | 9/2008 | Malvar | |
| 2009/0204394 | A1 | 8/2009 | Xu et al. | |
| 2010/0027810 | A1 * | 2/2010 | Marton | 381/94.1 |

FOREIGN PATENT DOCUMENTS

| | | | |
|---|---|---|---|
| JP | HE108286698 | A | 11/1996 |
| JP | 2002517025 | A | 6/2002 |
| JP | 2004120619 | A | 4/2004 |
| JP | 2006215569 | A | 8/2006 |
| JP | 2007049491 | A | 2/2007 |
| JP | 2008261904 | A | 10/2008 |

OTHER PUBLICATIONS

Pierre Lauber et al.: "Error Concealment for Compressed Digital Audio", Preprints of Papers Presented at the AES Convention, Sep. 1, 2001, pp. 1-11, XP008075936.

Wainhouse Research, "Polycom's Lost Packet Recovery (LPR) Capability," copyright 2008, 14-pgs.

Polycom, Inc., "G.719: The First ITU-T Standard for Full-Band Audio," Apr. 2009, 9-pgs.

Polycom, Inc., "Polycom(R) SirenTM/G.722.1," obtained from http://www.polycom.com, generated Jan. 22, 2010.

Polycom, Inc., "Polycom(R) SirenTM 22," obtained from http://www.polycom.com, generated Jan. 22, 2010.

Xie, et al., "ITU-T G.722.1 Annex C: A New Low-Complexity 14 Khz Audio Coding Standard," ICASSP 2006, 21-pgs.

Westerlund, et al., "Draft: RTP Payload format for G.719," Jun. 16, 2008, 25-pgs.

Westerlund, et al., "RFC5404: RTP Payload format for G.719," Jan. 2009, 26-pgs.

Malvar, Henrique, "A Modulated Complex Lapped Transform and its Applications to Audio Processing," Microsoft Research Technical Report MSR-TR-99-27, May 1999, 9-pgs.

Polycom, Inc., Polycom(R) SirenTM 14/G 722.1C FAQs, obtained from http://www.polycom.com, generated Jan. 22, 2010, 3-pgs.

International Telecommunication Union, ITU-T G.719 "Low-complexity, full-band audio coding for high-quality, conversational applications," Jun. 2008, 58-pgs.

International Telecommunication Union, ITU-T G.722.1 "Low-complexity coding at 24 and 32 kbit/s for hands-free operation in systems with low frame loss," May 2005, 36-pgs.

First Office Action in counterpart Japanese Appl. No. 2011-017313, mailed Oct. 2, 2012.

* cited by examiner

AUDIO PACKET LOSS CONCEALMENT BY TRANSFORM INTERPOLATION

BACKGROUND

Many types of systems use audio signal processing to create audio signals or to reproduce sound from such signals. Typically, signal processing converts audio signals to digital data and encodes the data for transmission over a network. Then, signal processing decodes the data and converts it back to analog signals for reproduction as acoustic waves.

Various ways exits for encoding or decoding audio signals. (A processor or a processing module that encodes and decodes a signal is generally referred to as a codec.) For example, audio processing for audio and video conferencing uses audio codecs to compress high-fidelity audio input so that a resulting signal for transmission retains the best quality but requires the least number of bits. In this way, conferencing equipment having the audio codec needs less storage capacity, and the communication channel used by the equipment to transmit the audio signal requires less bandwidth.

ITU-T (International Telecommunication Union Telecommunication Standardization Sector) Recommendation G.722 (1988), entitled "7 kHz audio-coding within 64 kbit/s," which is hereby incorporated by reference, describes a method of 7 kHz audio-coding within 64 kbit/s. ISDN lines have the capacity to transmit data at 64 kbit/s. This method essentially increases the bandwidth of audio through a telephone network using an ISDN line from 3 kHz to 7 kHz. The perceived audio quality is improved. Although this method makes high quality audio available through the existing telephone network, it typically requires ISDN service from a telephone company, which is more expensive than a regular narrow band telephone service.

A more recent method that is recommended for use in telecommunications is the ITU-T Recommendation G.722.1 (2005), entitled "Low-complexity coding at 24 and 32 kbit/s for hands-free operation in system with low frame loss," which is hereby incorporated herein by reference. This Recommendation describes a digital wideband coder algorithm that provides an audio bandwidth of 50 Hz to 7 kHz, operating at a bit rate of 24 kbit/s or 32 kbit/s, much lower than the G.722. At this data rate, a telephone having a regular modem using the regular analog phone line can transmit wideband audio signals. Thus, most existing telephone networks can support wideband conversation, as long as the telephone sets at the two ends can perform the encoding/decoding as described in G.722.1.

Some commonly used audio codecs use transform coding techniques to encode and decode audio data transmitted over a network. For example, ITU-T Recommendation G.719 (Polycom® Siren™22) as well as G.722.1.C (Polycom® Siren14™), both of which are incorporated herein by reference, use the well-known Modulated Lapped Transform (MLT) coding to compress the audio for transmission. As is known, the Modulated Lapped Transform (MLT) is a form of a cosine modulated filter bank used for transform coding of various types of signals.

In general, a lapped transform takes an audio block of length L and transforms that block into M coefficients, with the condition that L>M. For this to work, there must be an overlap between consecutive blocks of L−M samples so that a synthesized signal can be obtained using consecutive blocks of transformed coefficients.

For a Modulated Lapped Transform (MLT), the length L of the audio block is equal to the number M of coefficients so the overlap is M. Thus, the MLT basis function for the direct (analysis) transform is given by:

$$p_a(n,k) = h_a(n)\sqrt{\frac{2}{M}}\cos\left[\left(n+\frac{M+1}{2}\right)\left(k+\frac{1}{2}\right)\frac{\pi}{M}\right] \tag{1}$$

Similarly, the MLT basis function for the inverse (synthesis) transform is given by:

$$p_s(n,k) = h_s(n)\sqrt{\frac{2}{M}}\cos\left[\left(n+\frac{M+1}{2}\right)\left(k+\frac{1}{2}\right)\frac{\pi}{M}\right] \tag{2}$$

In these equations, M is the block size, the frequency index k varies from 0 to M−1, and the time index n varies from 0 to 2M−1. Lastly, $$h_a(n) = h_s(n) = -\sin\left[\left(n+\frac{1}{2}\right)\frac{\pi}{2M}\right]$$

are the perfect reconstruction windows used.

MLT coefficients are determined from these basis functions as follows. The direct transform matrix $P_a$ is the one whose entry in the n-th row and k-th column is $p_a(n,k)$. Similarly, the inverse transform matrix $P_s$ is the one with entries $p_s(n,k)$. For a block x of 2M input samples of an input signal x(n), its corresponding vector $\vec{X}$ of transform coefficients is computed by $\vec{X}=P_a^T x$. In turn, for a vector $\vec{Y}$ of processed transform coefficients, the reconstructed 2M sample vector y is given by $y=P_S\vec{Y}$. Finally, the reconstructed y vectors are superimposed on one another with M-sample overlap to generate the reconstructed signal y(n) for output.

FIG. 1 shows a typical audio or video conferencing arrangement in which a first terminal 10A acting as a transmitter sends compressed audio signals to a second terminal 10B acting as a receiver in this context. Both the transmitter 10A and receiver 10B have an audio codec 16 that performs transform coding, such as used in G.722.1.C (Polycom® Siren14™) or G.719 (Polycom® Siren™22).

A microphone 12 at the transmitter 10A captures source audio, and electronics sample source audio into audio blocks 14 typically spanning 20-milliseconds. At this point, the transform of the audio codec 16 converts the audio blocks 14 to sets of frequency domain transform coefficients. Each transform coefficient has a magnitude and may be positive or negative. Using techniques known in the art, these coefficients are then quantized 18, encoded, and sent to the receiver via a network 20, such as the Internet.

At the receiver 10B, a reverse process decodes and dequantizes 19 the encoded coefficients. Finally, the audio codec 16 at the receiver 10B performs an inverse transform on the coefficients to convert them back into the time domain to produce output audio block 14 for eventual playback at the receiver's loudspeaker 13.

Audio packet loss is a common problem in videoconferencing and audio conferencing over the networks such as the Internet. As is known, audio packets represent small segments of audio. When the transmitter 10A sends packets of the transform coefficients over the Internet 20 to the receiver 10B, some packets may become lost during transmission. Once output audio is generated, the lost packets would create gaps of silence in what is output by the loudspeaker 13. Therefore, the receiver 10B preferably fills such gaps with some form of audio that has been synthesized from those packets already received from the transmitter 10A.

As shown in FIG. 1, the receiver 10B has a lost packet detection module 15 that detects lost packets. Then, when outputting audio, an audio repeater 17 fills the gaps caused by such lost packets. An existing technique used by the audio repeater 17 simply fills such gaps in the audio by continually repeating in the time domain the most recent segment of audio sent prior to the packet loss. Although effective, the existing technique of repeating audio to fill gaps can produce buzzing and robotic artifacts in the resulting audio, and users tend to find such artifacts objectionable. Moreover, if more than 5% if packets are lossed, the current technique produce progressively less intelligible audio.

As a result, what is needed is a technique for dealing with lost audio packets when conferencing over the Internet in a way that produces better audio quality and avoids buzzing and robotic artifacts.

SUMMARY

Audio processing techniques disclosed herein can be used for audio or video conferencing. In the processing techniques, a terminal receives audio packets having transform coefficients for reconstructing an audio signal that has undergone transform coding. When receiving the packets, the terminal determines whether there are any missing packets and interpolates transform coefficients from the preceding and following good frames for insertion as coefficients for the missing packets. To interpolate the missing coefficients, for example, the terminal weighs first coefficients from the preceding good frame with a first weighting, weighs second coefficients from the following good frame with a second weighting, and sums these weighted coefficients together for insertion into the missing packets. The weightings can be based on the audio frequency and/or the number of missing packets involved. From this interpolation, the terminal produces an output audio signal by inverse transforming the coefficients.

The foregoing summary is not intended to summarize each potential embodiment or every aspect of the present disclosure.

DETAILED DESCRIPTION

Figure 1:
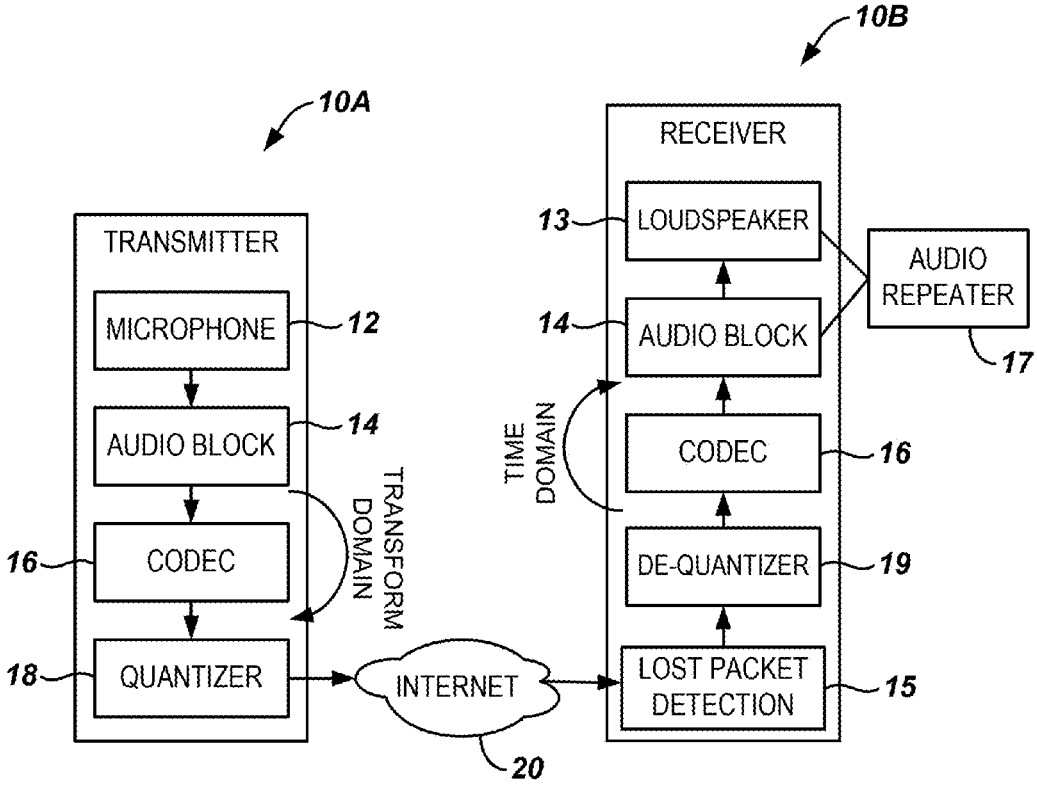
FIG. 1 (Prior Art)
FIG. 1 illustrates a conferencing arrangement having a transmitter and a receiver and using lost packet techniques according to the prior art.
Figure 2A:
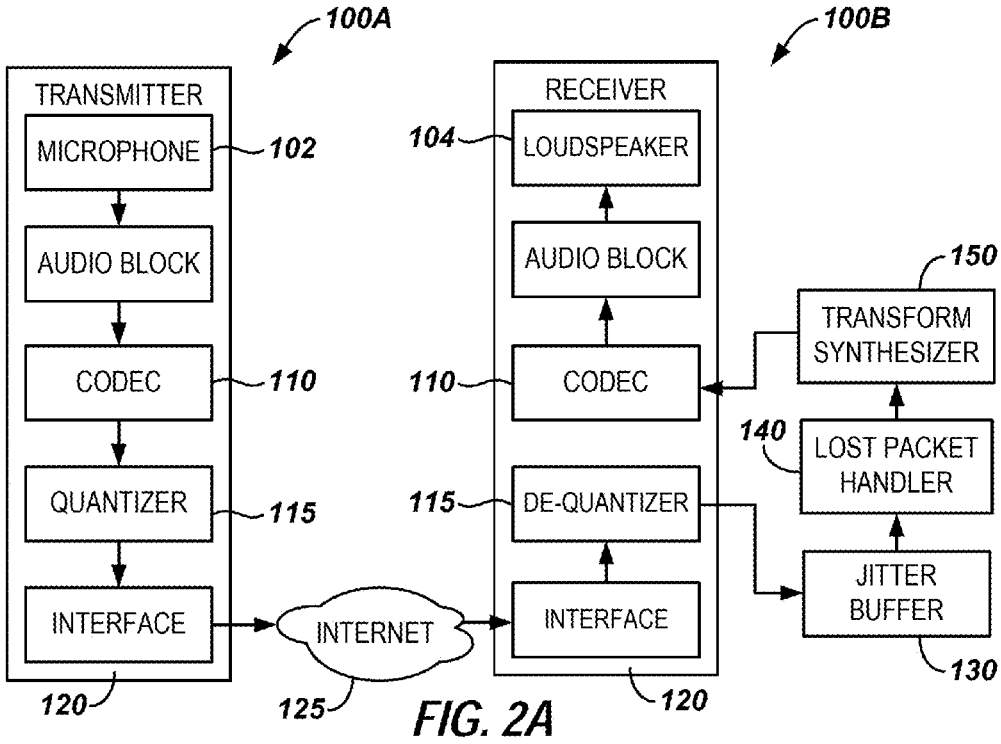
FIG. 2A illustrates a conferencing arrangement having a transmitter and a receiver and using lost packet techniques according to the present disclosure.

FIG. 2A shows an audio processing arrangement in which a first terminal 100A acting as a transmitter sends compressed audio signals to a second terminal 100B acting as a receiver in this context. Both the transmitter 100A and receiver 100B have an audio codec 110 that performs transform encoding, such as used in G.722.1.C (Polycom® Siren14™) or G.719 (Polycom® Siren™22). For the present discussion, the transmitter and receiver 100A-B can be endpoints in an audio or video conference, although they may be other types of audio devices.

During operation, a microphone 102 at the transmitter 100A captures source audio, and electronics sample blocks or frames of that typically spans 20-milliseconds. (Discussion concurrently refers to the flow chart in FIG. 3 showing a lost packet handling technique 300 according to the present disclosure.) At this point, the transform of the audio codec 110 converts each audio block to a set of frequency domain transform coefficients. To do this, the audio codec 110 receives audio data in the time domain (Block 302), takes a 20-ms audio block or frame (Block 304), and converts the block into transform coefficients (Block 306). Each transform coefficient has a magnitude and may be positive or negative.

Using techniques known in the art, these transform coefficients are then quantized with a quantizer 120 and encoded (Block 308), and the transmitter 100A sends the encoded transform coefficients in packets to the receiver 100B via a network 125, such as an IP (Internet Protocol) network, PSTN (Public Switched Telephone Network), ISDN (Integrated Services Digital Network), or the like (Block 310). The packets can use any suitable protocols or standards. For example, audio data may follow a table of contents, and all octets comprising an audio frame can be appended to the payload as a unit. For example, details of the audio frames are specified in ITU-T Recommendations G.719 and G.722.1C, which have been incorporated herein.

At the receiver 100B, an interface 120 receives the packets (Block 312). When sending the packets, the transmitter 100A creates a sequence number that is included in each packet sent. As is known, packets may pass through different routes over the network 125 from the transmitter 100A to the receiver 100B, and the packets may arrive at varying times at the receiver 100B. Therefore, the order in which the packets arrive may be random.

To handle this varying time of arrival, called "jitter," the receiver 100B has a jitter buffer 130 coupled to the receiver's interface 120. Typically, the jitter buffer 130 holds four or more packets at a time. Accordingly, the receiver 100B reorders the packets in the jitter buffer 130 based on their sequence numbers (Block 314).

Although the packets may arrive out-of-order at the receiver 100B, the lost packet handler 140 properly re-orders the packets in the jitter buffer 130 and detects any lost (missing) packets based on the sequence. A lost packet is declared when there are gaps in the sequence numbers of the packets in the jitter buffer 130. For example, if the handler 140 discovers sequence numbers 005, 006, 007, 011 in the jitter buffer 130, then the handler 140 can declare the packets 008, 009, 010 as lost. In reality, these packets may not actually be lost and may only be late in their arrival. Yet, due to latency and buffer length restrictions, the receiver 100B discards any packets that arrive late beyond some threshold.

In a reverse process that follows, the receiver 100B decodes and de-quantizes the encoded transform coefficients (Block 316). If the handler 140 has detected lost packets (Decision 318), the lost packet handler 140 knows what good packets preceded and followed the gap of lost packets. Using this knowledge, the transform synthesizer 150 derives or interpolates the missing transform coefficients of the lost packets so the new transform coefficients can be substituted in place of the missing coefficients from the lost packets (Block 320). (In the present example, the audio codec uses MLT coding so that the transform coefficients may be referred to herein as MLT coefficients.) At this stage, the audio codec 110 at the receiver 100B performs an inverse transform on the coefficients and convert them back into the time domain to produce output audio for the receiver's loudspeaker (Blocks 322-324).

As can be seen in the above process, rather than detect lost packets and continually repeat the previous segment of received audio to fill the gap, the lost packet handler 140 handles lost packets for the transform-based codec 110 as a lost set of transform coefficients. The transform synthesizer 150 then replaces the lost set of transform coefficients from the lost packets with synthesized transform coefficients derived from neighboring packets. Then, a full audio signal without audio gaps from lost packets can be produced and output at the receiver 100B using an inverse transform of the coefficients.

Figure 2B:
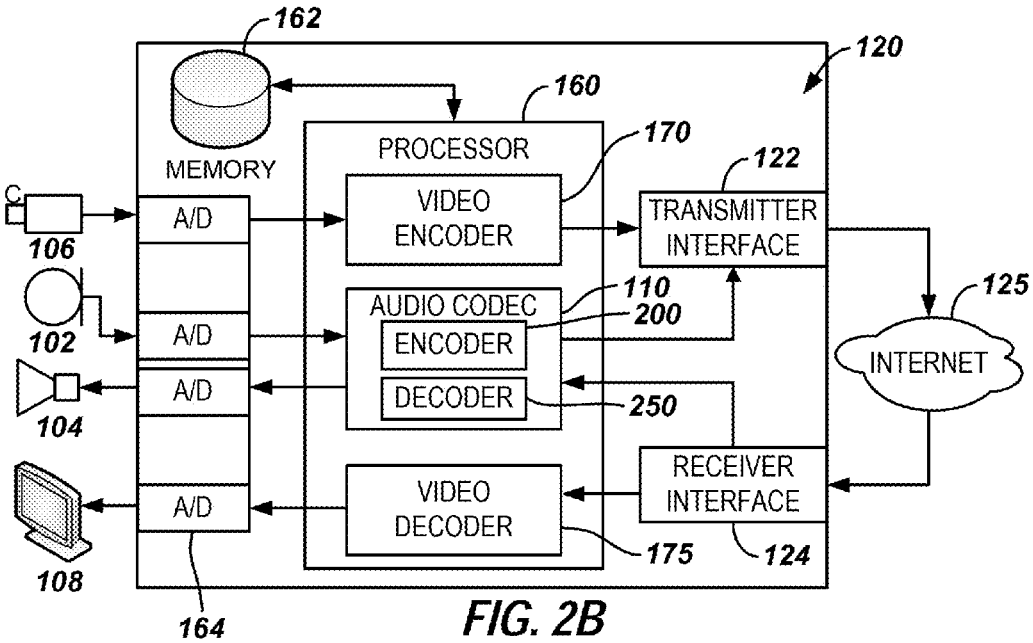
FIG. 2B illustrates a conferencing terminal in more detail.

FIG. 2B schematically shows a conferencing endpoint or terminal 100 in more detail. As shown, the conferencing terminal 100 can be both a transmitter and receiver over the IP network 125. As also shown, the conferencing terminal 100 can have videoconferencing capabilities as well as audio capabilities. In general, the terminal 100 has a microphone 102 and a speaker 104 and can have various other input/output devices, such as video camera 106, display 108, keyboard, mouse, etc. Additionally, the terminal 100 has a processor 160, memory 162, converter electronics 164, and network interfaces 122/124 suitable to the particular network 125. The audio codec 110 provides standard-based conferencing according to a suitable protocol for the networked terminals. These standards may be implemented entirely in software stored in memory 162 and executing on the processor 160, on dedicated hardware, or using a combination thereof.

In a transmission path, analog input signals picked up by the microphone 102 are converted into digital signals by converter electronics 164, and the audio codec 110 operating on the terminal's processor 160 has an encoder 200 that encodes the digital audio signals for transmission via a transmitter interface 122 over the network 125, such as the Internet. If present, a video codec having a video encoder 170 can perform similar functions for video signals.

In a receive path, the terminal 100 has a network receiver interface 124 coupled to the audio codec 110. A decoder 250 decodes the received signal, and converter electronics 164 convert the digital signals to analog signals for output to the loudspeaker 104. If present, a video codec having a video decoder 172 can perform similar functions for video signals.

Figure 3A:
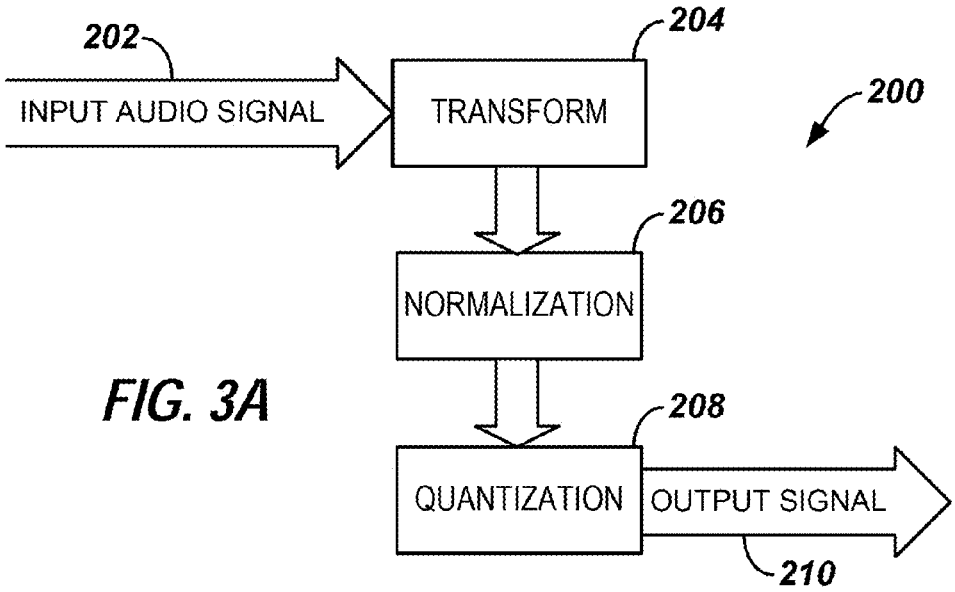
FIGS. 3A-3B respectively show an encoder and decoder of a transform coding codec.
Figure 3B:
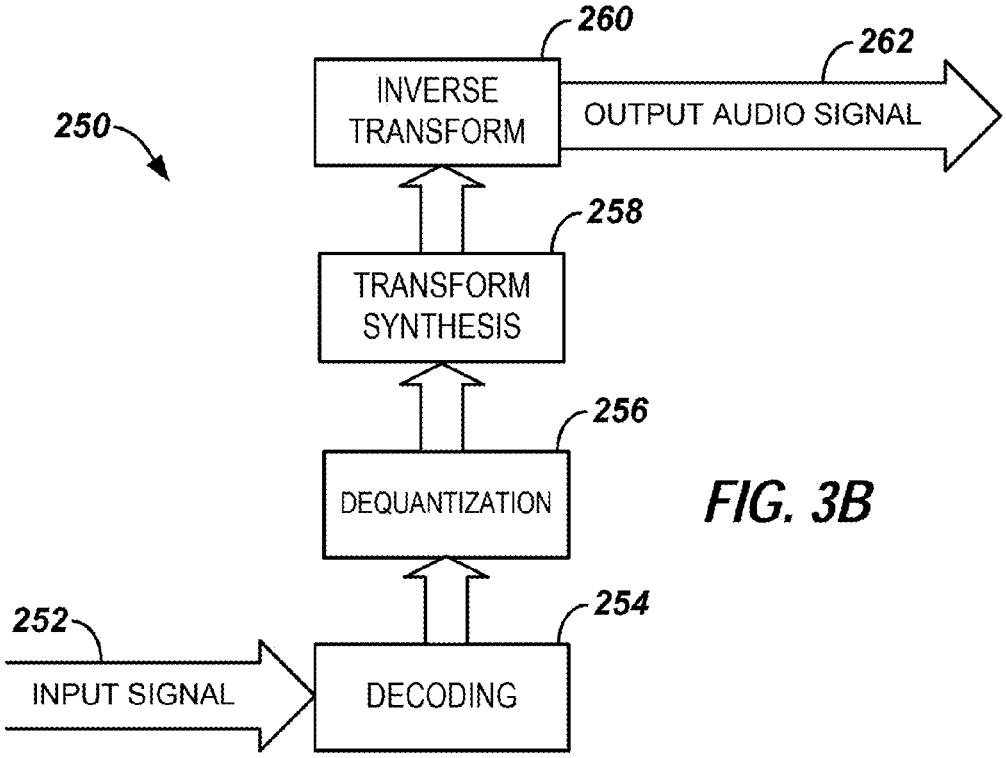
Figure 4:
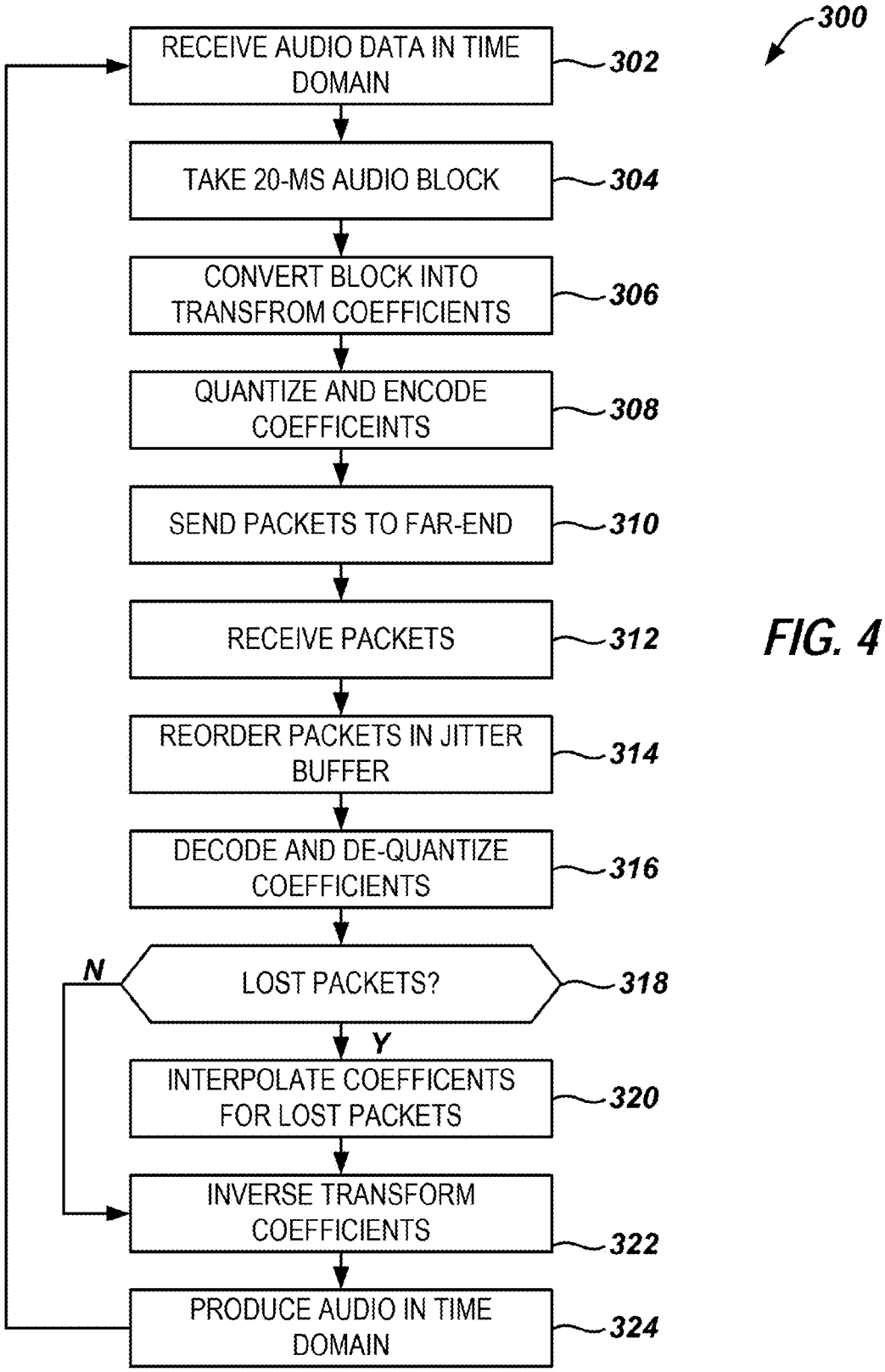
FIG. 4 is a flow chart of a coding, decoding, and lost packet handling technique according to the present disclosure.

FIGS. 3A-3B briefly show features of a transform coding codec, such as a Siren codec. Actual details of a particular audio codec depend on the implementation and the type of codec used. Known details for Siren14™ can be found in ITU-T Recommendation G.722.1 Annex C, and known details for Siren™22 can be found in ITU-T Recommendation G.719 (2008) "Low-complexity, full-band audio coding for high-quality, conversational applications," which both have been incorporated herein by reference. Additional details related to transform coding of audio signals can also be found in U.S. patent application Ser. Nos. 11/550,629 and 11/550,682, which are incorporated herein by reference.

An encoder 200 for a transform coding codec (e.g., a Siren codec) is illustrated in FIG. 3A. The encoder 200 receives a digital signal 202 that has been converted from an analog audio signal. For example, this digital signal 202 may have been sampled at 48 kHz or other rate in about 20-ms blocks or frames. A transform 204, which can be a Discrete Cosine Transform (DCT), converts the digital signal 202 from the time domain into a frequency domain having transform coefficients. For example, the transform 204 can produce a spectrum of 960 transform coefficients for each audio block or frame. The encoder 200 finds average energy levels (norms) for the coefficients in a normalization process 206. Then, the encoder 202 quantizes the coefficients with a Fast Lattice Vector Quantization (FLVQ) algorithm 208 or the like to encode an output signal 208 for packetization and transmission.

A decoder 250 for the transform coding codec (e.g., Siren codec) is illustrated in FIG. 3B. The decoder 250 takes the incoming bit stream of the input signal 252 received from a network and recreates a best estimate of the original signal from it. To do this, the decoder 250 performs a lattice decoding (reverse FLVQ) 254 on the input signal 252 and de-quantizes the decoded transform coefficients using a de-quantization process 256. Also, the energy levels of the transform coefficients may then be corrected in the various frequency bands.

At this point, the transform synthesizer 258 can interpolate coefficients for missing packets. Finally, an inverse transform 260 operates as a reverse DCT and converts the signal from the frequency domain back into the time domain for transmission as an output signal 262. As can be seen, the transform synthesizer 258 helps to fill in any gaps that may result from the missing packets. Yet, all of the existing functions and algorithms of the decoder 200 remain the same.

With an understanding of the terminal 100 and the audio codec 110 provided above, discussion now turns to how the audio codec 100 interpolates transform coefficients for missing packets by using good coefficients from neighboring frames, blocks, or sets of packets received over the network. (The discussion that follows is presented in terms of MLT coefficients, but the disclosed interpolation process may apply equally well to other transform coefficients for other forms of transform coding).

Figure 5:
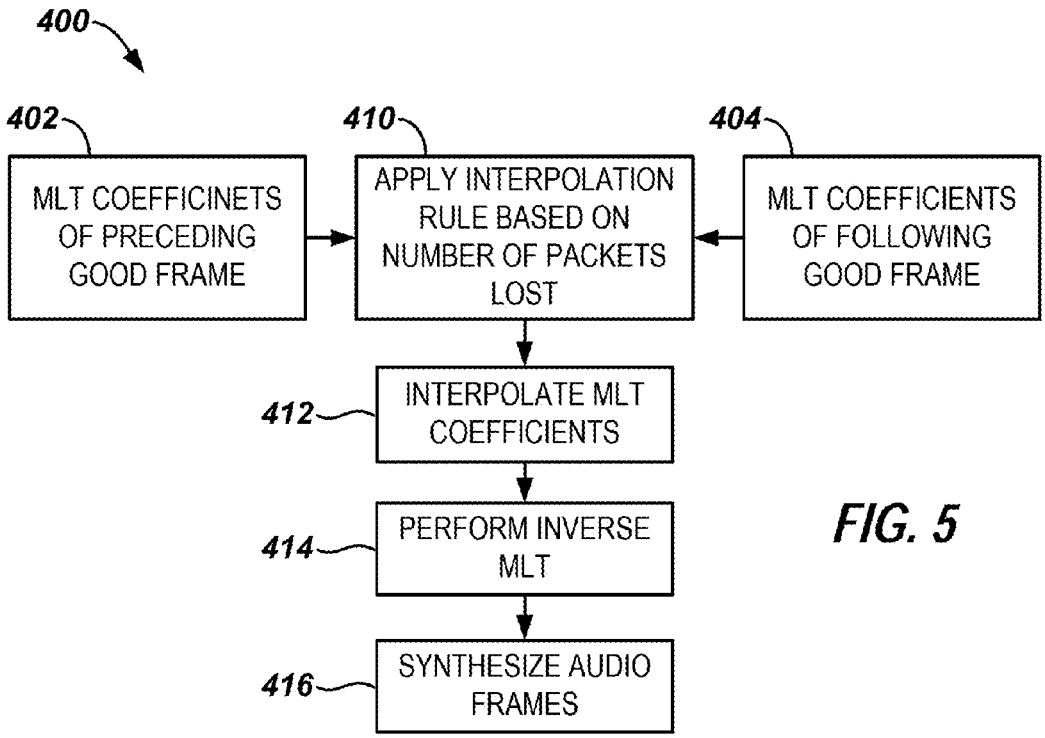
FIG. 5 diagrammatically shows a process for interpolating transform coefficients in lost packets according to the present disclosure.
Figure 6:
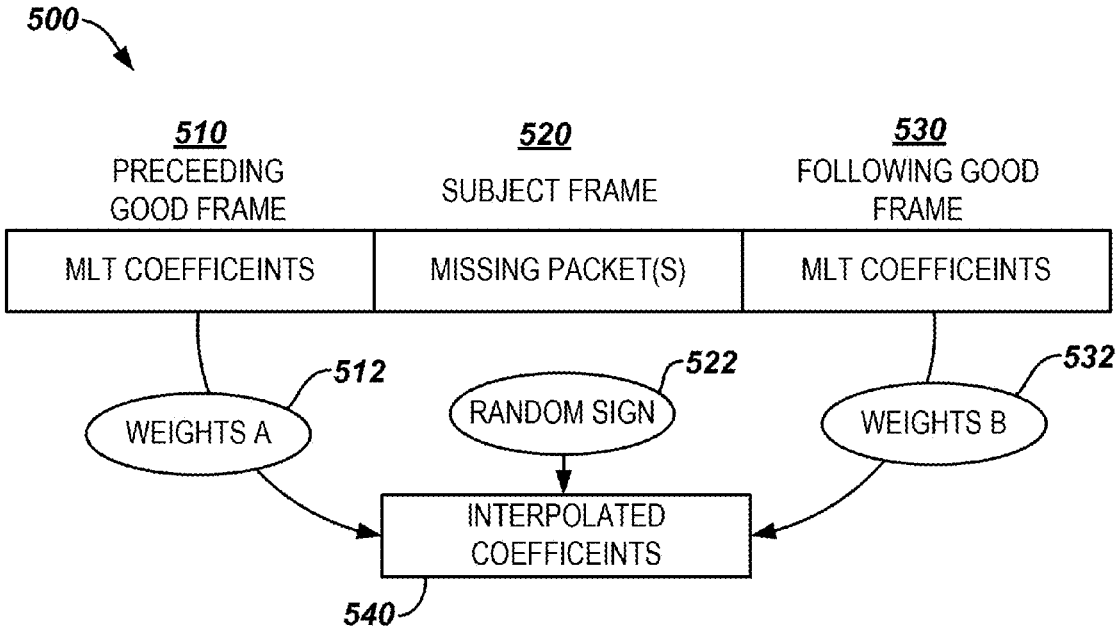
FIG. 6 diagrammatically shows an interpolation rule for the interpolating process.

As diagrammatically shown in FIG. 5, the process 400 for interpolating transform coefficients in lost packets involves applying an interpolation rule (Block 410) to transform coefficients from the preceding good frame, block, or set of packets (i.e., without lost packets) (Block 402) and from the following good frame, block, or set of packets (Block 404). Thus, the interpolation rule (Block 410) determines the number of packets lost in a given set and draws from the transform coefficients from the good sets (Blocks 402/404) accordingly. Then, the process 400 interpolates new transform coefficients for the lost packets for insertion into the given set (Block 412). Finally, the process 400 performs an inverse transform (Block 414) and synthesizes the audio sets for output (Block 416).

FIG. 5 diagrammatically shows the interpolation rule 500 for the interpolating process in more detail. As discussed previously, the interpolation rule 500 is a function of the number of lost packets in a frame, audio block, or set of packets. The actual frame size (bits/octets) depends on the transform coding algorithm, bit rate, frame length, and sample rate used. For example, for G.722.1 Annex C at a 48 kbit/s bit rate, a 32 kHz sample rate, and a frame length of 20-ms, the frame size will be 960 bits/120 octets. For G.719, the frame is 20-ms, the sampling rate is 48 kHz, and the bit rate can be changed between 32 kbit/s and 128 kbit/s at any 20-ms frame boundary. The payload format for G.719 is specified in RFC 5404.

In general, a given packet that is lost may have one or more frames (e.g., 20-ms) of audio, may encompass only a portion of a frame, can have one or more frames for one or more channels of audio, can have one or more frames at one or more different bit rates, and can other complexities known to those skilled in the art and associated with the particular transform coding algorithm and payload format used. However, the interpolation rule 500 used to interpolate the missing transform coefficients for the missing packets can be adapted to the particular transform coding and payload formats in a given implementation.

As shown, the transform coefficients (shown here as MLT coefficients) of the preceding good frame or set 510 are called $MLT_A(i)$, and the MLT coefficients of the following good frame or set 530 are called $MLT_B(i)$. If the audio codec uses Siren™22, the index (i) ranges from 0 to 959. The general interpolation rule 520 for the absolute value the interpolated MLT coefficients 540 for the missing packets is determined based on weights 512/532 applied to the preceding and following MLT coefficients 510/230 as follows:

$$|MLT_{Interpolated}(i)| = \text{Weight}_A * |MLT_A(i)| + \text{Weight}_B * |MLT_B(i)|$$

In the general interpolation rule, the sign 522 for the interpolated MLT coefficients, $MLT_{Interpolated}(i)$, 540 of the missing frame or set is randomly set as either positive or negative with equal probability. This randomness may help the audio resulting from these reconstructed packets sound more natural and less robotic.

After interpolating the MLT coefficients 540 in this way, the transform synthesizer (150; FIG. 2A) fills in the gaps of the missing packets, the audio codec (110; FIG. 2A) at the receiver (100B) can then complete its synthesis operation to reconstruct the output signal. Using known techniques, for example, the audio codec (110) takes a vector $\vec{Y}$ of processed transform coefficients, which include the good MLT coefficients received as well as the interpolated MLT coefficients filled in where necessary. From this vector $\vec{Y}$, the codec (110) reconstructs a 2M sample vector y, which is given by $y = P_S\vec{Y}$. Finally, as processing continues, the synthesizer (150) takes the reconstructed y vectors and superimposes them with M-sample overlap to generate a reconstructed signal y(n) for output at the receiver (100B).

As the number of missing packets varies, the interpolation rule 500 applies different weights 512/532 to the preceding and following MLT coefficients 510/530 to determine the interpolated MLT coefficients 540. Below are particular rules for determining the two weight factors, $\text{Weight}_A$ and $\text{Weight}_B$, based on the number of missing packets and other parameters.

1. Single Lost Packet

Figure 7A:
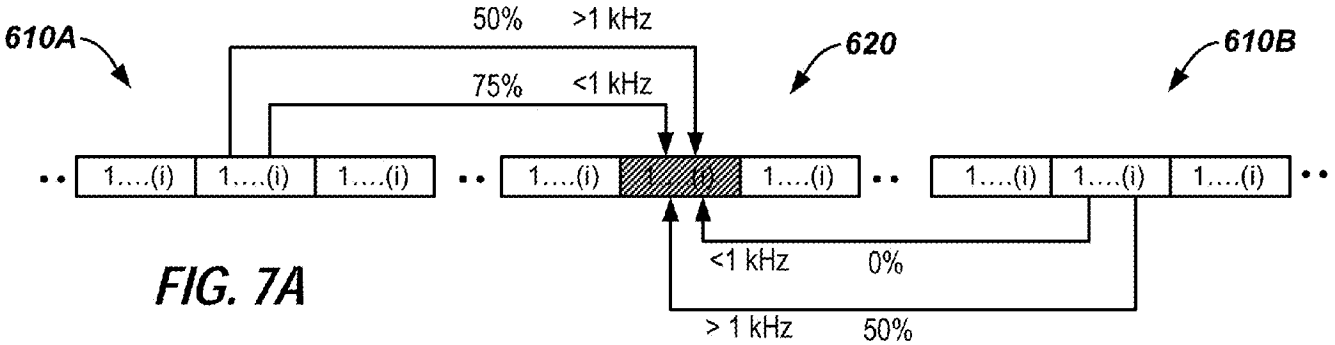
FIGS. 7A-7C diagrammatically show weights used to interpolate transform coefficients for missing packets.

As diagramed in FIG. 7A, the lost packet handler (140; FIG. 2A) may detect a single lost packet in a subject frame or set of packets 620. If a single packet is lost, the handler (140) uses weight factors ($\text{Weight}_A$, $\text{Weight}_B$) for interpolating the missing MLT coefficients for the lost packet based on frequency of the audio related to the missing packet (e.g., the current frequency of audio preceding the missing packet). As shown in the chart below, the weight factor ($\text{Weight}_A$) for the corresponding packet in the preceding frame or set 610A, and the weight factor ($\text{Weight}_B$) for the corresponding packet in the following frame or set 610B can be determined relative to a 1 kHz frequency of the current audio as follows:

| Frequencies | $\text{Weight}_A$ | $\text{Weight}_B$ |
|---|---|---|
| Below 1 kHz | 0.75 | 0.0 |
| Above 1 kHz | 0.5 | 0.5 |

2. Two Lost Packets

Figure 7B:
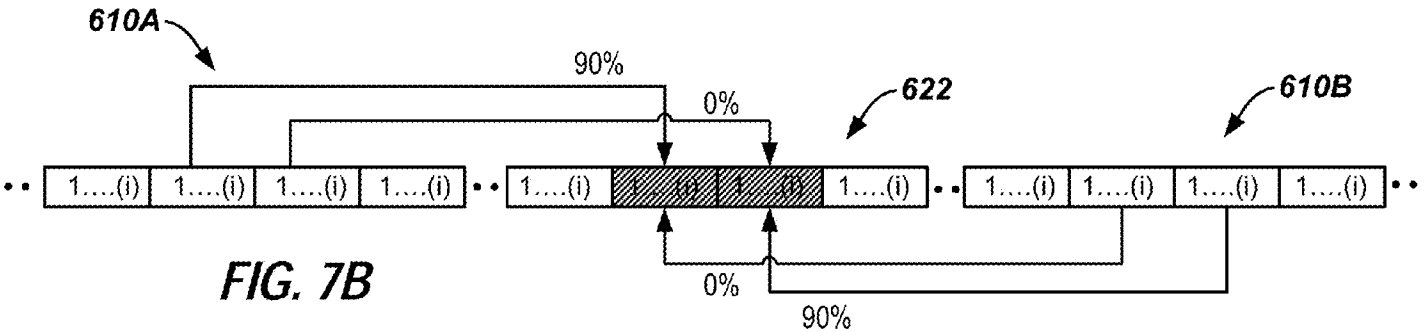

As diagramed in FIG. 7B, the lost packet handler (140) may detect two lost packet in a subject frame or set 622. In this situation, the handler (140) uses weight factors ($\text{Weight}_A$, $\text{Weight}_B$) for interpolating MLT coefficients for the missing packets in corresponding packets of the preceding and following frames or sets 610A-B as follows:

| Lost Packet | $\text{Weight}_A$ | $\text{Weight}_B$ |
|---|---|---|
| First (Older) Packet | 0.9 | 0.0 |
| Last (Newer) Packet | 0.0 | 0.9 |

If each packet encompasses one frame of audio (e.g., 20-ms), then each set 610A-B and 622 of FIG. 7B would essentially include several packets (i.e., several frames) so that additional packets may not actually be in the sets 610A-B and 622 as depicted in FIG. 7A.

3. Three to Six Lost Packets

Figure 7C:
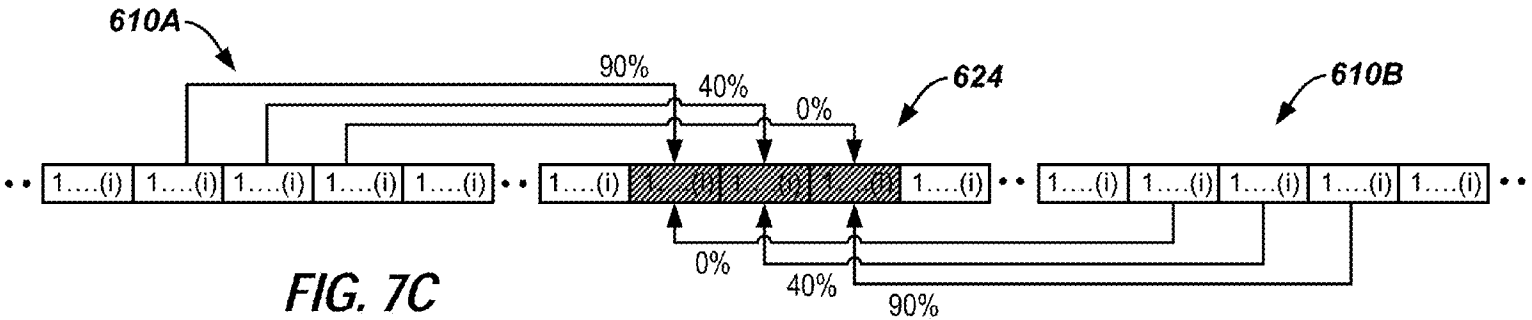

As diagramed in FIG. 7C, the lost packet handler (140) may detect three to six lost packets in a subject frame or set 624 (three are shown in FIG. 7C). Three to six missing packets may represent as much as 25% of packets being lost at a given time interval. In this situation, the handler (140) uses weight factors ($\text{Weight}_A$, $\text{Weight}_B$) for interpolating MLT coefficients for the missing packets in corresponding packets of the preceding and following frames or sets 610A-B as follows:

| Lost Packet | $\text{Weight}_A$ | $\text{Weight}_B$ |
|---|---|---|
| First (Older) Packet | 0.9 | 0.0 |
| One or More Middle Packets | 0.4 | 0.4 |
| Last (Newer) Packet | 0.0 | 0.9 |

The arrangement of the packets and the frames or sets in the diagrams of FIGS. 7A-7C are meant to be illustrative. As noted previously, some coding techniques may use frames that encompass a particular length (e.g., 20-ms) of audio. Also, some techniques may use one packet for each frame (e.g., 20-ms) of audio. Depending on the implementation, however, a given packet may have information for one or more frames of audio (e.g., 20-ms) or may have information for only a portion of one frame of audio (e.g., 20-ms).

To define weight factors for interpolating missing transform coefficients, the parameters described above use frequency levels, the number of packets missing in a frame, and the location of a missing packet in a given set of missing packets. The weight factors may be defined using any one or combination of these interpolation parameters. The weight factors ($\text{Weight}_A$, $\text{Weight}_B$), frequency threshold, and interpolation parameters disclosed above for interpolating transform coefficients are illustrative. These weight factors, thresholds, and parameters are believed to produce the best subjective quality of audio when filling in gaps from missing packets during a conference. Yet, these factors, thresholds, and parameters may differ for a particular implementation, may be expanded beyond what is illustratively presented, and may depend on the types of equipment used, the types of audio involved (i.e., music, voice, etc.), the type of transform coding applied, and other considerations.

In any event, when concealing lost audio packets for transform-based audio codecs, the disclosed audio processing techniques produce better quality sound than the prior art solutions. In particular, even if 25% of packets are lost, the disclosed technique may still produce audio that is more intellible than current techniques. Audio packet loss occurs often in videoconferencing applications, so improving quality during such conditions is important to improving the overall videoconferencing experience. Yet, it is important that steps taken to conceal packet loss not require too much processing or storage resources at the terminal operating to conceal the loss. By applying weightings to transform coefficients in preceding and following good frames, the disclosed techniques can reduce the processing and storage resources needed.

Although described in terms of audio or video conferencing, the teachings of the present disclosure may be useful in other fields involving streaming media, including streaming music and speech. Therefore, the teachings of the present disclosure can be applied to other audio processing devices in addition to an audio conferencing endpoint and a videoconferencing endpoint, including an audio playback device, a personal music player, a computer, a server, a telecommunications device, a cellular telephone, a personal digital assistant, etc. For example, special purpose audio or videoconferencing endpoints may benefit from the disclosed techniques. Likewise, computers or other devices may be used in desktop conferencing or for transmission and receipt of digital audio, and these devices may also benefit from the disclosed techniques.

The techniques of the present disclosure can be implemented in electronic circuitry, computer hardware, firmware, software, or in any combinations of these. For example, the disclosed techniques can be implemented as instruction stored on a program storage device for causing a programmable control device to perform the disclosed techniques. Program storage devices suitable for tangibly embodying program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An audio processing method, comprising:

receiving sets of packets at an audio processing device via a network, each set having one or more of the packets, each packet having transform coefficients in a frequency domain for reconstructing an audio signal in a time domain that has undergone transform coding;

Determining one or more missing packets in a given one of the sets received, the one or more missing packets sequenced in the given set with a given sequence;

applying a first weight to first transform coefficients of one or more first packets in a first set sequenced before the given set, the one or more first packets having a first sequence in the first set corresponding to the given sequence of the one or more missing packets in the given set;

applying a second weight to second transform coefficients of one or more second packets in a second set sequenced after the given set, the one or more second packets having a second sequence in the second set corresponding to the given sequence of the one or more missing packets in the given set;

interpolating transform coefficients by summing the corresponding first and second weighted transform coefficients;

inserting the interpolated transform coefficients into the given set in place of the one or more corresponding missing packets; and producing an output audio signal for the audio processing device by performing an inverse transform on the transform coefficients.

2. The method of claim 1, wherein the audio processing device is selected from the group consisting of an audio conferencing endpoint, a videoconferencing endpoint, an audio playback device, a personal music player, a computer, a server, a telecommunications device, a cellular telephone, and a personal digital assistant;

wherein the network comprises an Internet Protocol network;

wherein the transform coefficients comprise coefficients of a Modulated Lapped Transform; or wherein each set has one packet, the one packet encompassing a frame of input audio.

3. The method of claim 1, wherein receiving comprises decoding the packets and de-quantizing the decoded packets.

4. The method of claim 1, wherein determining the one or more missing packets comprises sequencing the packets received in a buffer and finding gaps in the sequencing.

5. The method of claim 1, wherein interpolating the transform coefficients comprises assigning a random positive or negative sign to the summed first and second weighted transform coefficients.

6. The method of claim 1, wherein the first and second weights applied to the first and second transform coefficients are based on audio frequencies.

7. The method of claim 6, wherein if the audio frequencies fall below a threshold, the first weight emphasizes the first transform coefficients, and the second weight de-emphasizes the second transform coefficients.

8. The method of claim 7, wherein the threshold is 1 kHz.

9. The method of claim 7, wherein the first transform coefficients are weighted at 75 percent, and wherein the second transform coefficients are zeroed.

10. The method of claim 6, wherein if the audio frequencies exceed a threshold, the first and second weights equally emphasize the first and second transform coefficients.

11. The method of claim 10, wherein the first and second transform coefficients are both weighted at 50 percent.

12. The method of claim 1, wherein the first and second weights applied to the first and second transform coefficients are based on a number of the missing packets.

13. The method of claim 12, wherein if one of the packets is missing in the given set, the first weight emphasizes the first transform coefficients and the second weight de-emphasizes the second transform coefficients if an audio frequency related to the missing packet falls below a threshold; and the first and second weights equally emphasize the first and second transform coefficients if the audio frequency exceeds the threshold.

14. The method of claim 12, wherein if two of the packets are missing in the given set, the first weighting emphasizes the first transform coefficients for a preceding one of the two packets and de-emphasizes the first transform coefficients for a following one of the two packets; and the second weighting de-emphasizes the second transform coefficients for the preceding packet and emphasizes the second transform coefficients for the following packet.

15. The method of claim 14, wherein the emphasized coefficients are weighted at 90 percent, and wherein the de-emphasized coefficients are zeroed.

16. The method of claim 12, wherein if three or more packets are missing in the given set, the first weighting emphasizes the first transform coefficients for a first one of the packets and de-emphasizes the first transform coefficients for a last one of the packets;

the first and second weightings equally emphasizes the first and second transform coefficients for one or more intermediate ones of the packets; and the second weighting de-emphasizes the second transform coefficients for the first one of the packets and emphasizes the second transform coefficients for the last of the packets.

17. The method of claim 16, wherein the emphasized coefficients are weighted at 90 percent, wherein the de-emphasized coefficients are zeroed, and wherein the equally emphasized coefficients are weighted at 40 percent.

18. An audio processing device, comprising:

an audio output interface;

a network interface in communication with at least one network and receiving sets of packets of audio, each set having one or more of the packets, each packet having transform coefficients in a frequency domain;

memory in communication with the network interface and storing the received packets;

a processing unit in communication with the memory and the audio output interface, the processing unit programmed with an audio decoder configured to:

determine one or more missing packets in a given one of the sets received, the one or more missing packets sequenced in the given set with a given sequence;

apply a first weighting to first transform coefficients of one or more first packets from a first set sequenced before the given set, the one or more first packets having a first sequence in the first set corresponding to the given sequence of the one or more missing packets in the given set;

apply a second weighting to second transform coefficients of one or more second packets from a second set sequenced after the given set, the one or more second packets having a second sequence in the second set corresponding to the given sequence of the one or more missing packets in the given set;

interpolate transform coefficients by summing the corresponding first and second weighted transform coefficients;

insert the interpolated transform coefficients into the given set in place of the corresponding one or more missing packets; and perform an inverse transform on the transform coefficients to produce an output audio signal in a time domain for the audio output interface.

19. The device of claim 18, wherein the device comprises a conferencing endpoint.

20. The device of claim 18, further comprising a speaker communicably coupled to the audio output interface.

21. The device of claim 18, further comprising an audio input interface and a microphone communicably coupled to the audio input interface.

22. The device of claim 21, wherein the processing unit is in communication with the audio input interface and is programmed with an audio encoder configured to:

transform frames of time domain samples of an audio signal to frequency domain transform coefficients;

quantize the transform coefficients; and code the quantized transform coefficients.

23. The device of claim 18, wherein the first and second weights applied to the first and second transform coefficients are based on audio frequencies.

24. The device of claim 23, wherein if the audio frequencies fall below a threshold, the first weight emphasizes the first transform coefficients, and the second weight de-emphasizes the second transform coefficients.

25. The device of claim 24, wherein the threshold is 1 kHz.

26. The device of claim 24, wherein the first transform coefficients are weighted at 75 percent, and wherein the second transform coefficients are zeroed.

27. The device of claim 23, wherein if the audio frequencies exceed a threshold, the first and second weights equally emphasize the first and second transform coefficients.

28. The device of claim 27, wherein the first and second transform coefficients are both weighted at 50 percent.

29. The device of claim 18, wherein the first and second weights applied to the first and second transform coefficients are based on a number of the missing packets.

30. The device of claim 29, wherein if one of the packets is missing in the given set, the first weight emphasizes the first transform coefficients and the second weight de-emphasizes the second transform coefficients if an audio frequency related to the missing packet falls below a threshold; and the first and second weights equally emphasize the first and second transform coefficients if the audio frequency exceeds the threshold.

31. The device of claim 29, wherein if two of the packets are missing in the given set, the first weighting emphasizes the first transform coefficients for a preceding one of the two packets and de-emphasizes the first transform coefficients for a following one of the two packets; and the second weighting de-emphasizes the second transform coefficients for the preceding packet and emphasizes the second transform coefficients for the following packet.

32. The device of claim 31, wherein the emphasized coefficients are weighted at 90 percent, and wherein the de-emphasized coefficients are zeroed.

33. The device of claim 29, wherein if three or more packets are missing in the given set, the first weighting emphasizes the first transform coefficients for a first one of the packets and de-emphasizes the first transform coefficients for a last one of the packets;

the first and second weightings equally emphasizes the first and second transform coefficients for one or more intermediate ones of the packets; and the second weighting de-emphasizes the second transform coefficients for the first one of the packets and emphasizes the second transform coefficients for the last of the packets.

34. The device of claim 33, wherein the emphasized coefficients are weighted at 90 percent, wherein the de-emphasized coefficients are zeroed, and wherein the equally emphasized coefficients are weighted at 40 percent.

35. A program storage device having instructions stored thereon for causing a programmable control device to perform an audio processing method, the method comprising:

receiving sets of packets at an audio processing device via a network, each set having one or more of the packets, each packet having transform coefficients in a frequency domain for reconstructing an audio signal in a time domain that has undergone transform coding;

determining one or more missing packets in a given one of the sets received, the one or more missing packets sequenced in the given set with a given sequence;

applying a first weight to first transform coefficients of one or more first packets in a first set sequenced before the given set, the one or more first packets having a first sequence in the first set corresponding to the given sequence of the one or more missing packets in the given set;

applying a second weight to second transform coefficients of one or more second packets in a second set sequenced after the given set, the one or more second packets having a second sequence in the second set corresponding to the given sequence of the one or more missing packets in the given set;

interpolating transform coefficients by summing the corresponding first and second weighted transform coefficients;

inserting the interpolated transform coefficients into the given et in place of the corresponding one or more missing packets; and producing an output audio signal for the audio processing device by performing an inverse transform on the transform coefficients.

36. The program storage device of claim 35, wherein the audio processing device is selected from the group consisting of an audio conferencing endpoint, a videoconferencing endpoint, an audio playback device, a personal music player, a computer, a server, a telecommunications device, a cellular telephone, and a personal digital assistant;

wherein the network comprises an Internet Protocol network;

wherein the transform coefficients comprise coefficients of a Modulated Lapped Transform; or wherein each set has one packet, the one packet encompassing a frame of input audio.

37. The program storage device of claim 35, wherein the processing unit is programmed to decode the packets and de-quantize the decoded packets.

38. The program storage device of claim 35, wherein to determine the one or more missing packets, the processing unit is programmed to sequence the packets received in a buffer and find gaps in the sequencing.

39. The program storage device of claim 35, wherein to interpolate the transform coefficients, the processing unit is programmed to assign a random positive or negative sign to the summed first and second weighted transform coefficients.

40. The program storage device of claim 35, wherein the first and second weights applied to the first and second transform coefficients are based on audio frequencies.

41. The program storage device of claim 40, wherein if the audio frequencies fall below a threshold, the first weight emphasizes the first transform coefficients, and the second weight de-emphasizes the second transform coefficients.

42. The program storage device of claim 41, wherein the threshold is 1 kHz.

43. The program storage device of claim 41, wherein the first transform coefficients are weighted at 75 percent, and wherein the second transform coefficients are zeroed.

44. The program storage device of claim 40, wherein if the audio frequencies exceed a threshold, the first and second weights equally emphasize the first and second transform coefficients.

45. The program storage device of claim 44, wherein the first and second transform coefficients are both weighted at 50 percent.

46. The program storage device of claim 35, wherein the first and second weights applied to the first and second transform coefficients are based on a number of the missing packets.

47. The program storage device of claim 46, wherein if one of the packets is missing in the given set, the first weight emphasizes the first transform coefficients and the second weight de-emphasizes the second transform coefficients if an audio frequency related to the missing packet falls below a threshold; and the first and second weights equally emphasize the first and second transform coefficients if the audio frequency exceeds the threshold.

48. The program storage device of claim 46, wherein if two of the packets are missing in the given set, the first weighting emphasizes the first transform coefficients for a preceding one of the two packets and de-emphasizes the first transform coefficients for a following one of the two packets; and the second weighting de-emphasizes the second transform coefficients for the preceding packet and emphasizes the second transform coefficients for the following packet.

49. The program storage device of claim 48, wherein the emphasized coefficients are weighted at 90 percent, and wherein the de-emphasized coefficients are zeroed.

50. The program storage device of claim 46, wherein if three or more packets are missing in the given set, the first weighting emphasizes the first transform coefficients for a first one of the packets and de-emphasizes the first transform coefficients for a last one of the packets;

the first and second weightings equally emphasizes the first and second transform coefficients for one or more intermediate ones of the packets; and the second weighting de-emphasizes the second transform coefficients for the first one of the packets and emphasizes the second transform coefficients for the last of the packets.

51. The program storage device of claim 50, wherein the emphasized coefficients are weighted at 90 percent, wherein the de-emphasized coefficients are zeroed, and wherein the equally emphasized coefficients are weighted at 40 percent.

* * * * *